US005332166A

United States Patent [19]

Kepes

[11] Patent Number: 5,332,166

[45] Date of Patent: Jul. 26, 1994

[54] METHOD AND APPARATUS FOR WINDING OR UNWINDING CABLE ONTO A REEL

[76] Inventor: George Kepes, 8110 Arcadian Road, Cote-St-Luc, Quebec H4X 1A1, Canada

[21] Appl. No.: 913,409

[22] Filed: Jul. 15, 1992

[51] Int. Cl.[5] ..... B65H 75/30

[52] U.S. Cl. ..... 242/390.2; 242/393; 242/399.1; 242/399.2

[58] Field of Search ..... 242/54 R, 58.6, 79, 242/86.5 R, 86.51, 68.7, 78.7, 75.1

[56] References Cited

U.S. PATENT DOCUMENTS

| | | | |
|---|---|---|---|
| 2,670,907 | 3/1954 | Huck | 242/75.1 |
| 2,731,213 | 1/1956 | Groll | 242/78.7 |
| 2,977,058 | 3/1961 | Hornstein et al. | 242/55.1 |
| 2,984,429 | 5/1961 | Huck | 242/58.6 |
| 3,202,376 | 8/1965 | Dutro et al. | 242/75.1 |
| 3,325,118 | 6/1967 | Hall | 242/58.6 |
| 3,400,542 | 9/1968 | Davis | 242/75.1 X |
| 3,625,445 | 12/1971 | Hall | 242/54 R |
| 4,069,944 | 1/1978 | Achelpohl | 242/75.1 X |
| 4,542,861 | 9/1985 | Barnes | 242/86.5 R |
| 4,781,335 | 11/1988 | Compagnon | 242/54 R |
| 4,893,763 | 1/1990 | Wales et al. | 242/58.6 |
| 4,901,935 | 2/1990 | Reist | 242/68.7 |
| 5,123,602 | 6/1992 | Skalleberg et al. | 242/54 R |

*Primary Examiner*—John M. Jillions
*Attorney, Agent, or Firm*—Larson and Taylor

[57] ABSTRACT

An apparatus for winding or unwinding a cable from a flanged reel, comprising an assembly for rotatably supporting the reel and a reel drive including an endless belt tensioned around pulleys and frictionally engaging the peripheral edge of the reel flange. The advancement of the belt causes the reel to rotate in the desired direction. The invention also extends to a novel method for winding or unwinding cable from a flanged reel.

15 Claims, 2 Drawing Sheets

METHOD AND APPARATUS FOR WINDING OR UNWINDING CABLE ONTO A REEL

FIELD OF THE INVENTION

The invention relates to the art of cable handling equipment and more particularly to a novel method and apparatus for winding or unwinding cable from a reel.

BACKGROUND OF THE INVENTION

Multi-strand electrical power or communication cables are normally shipped and stored in a coiled condition on a flanged reel. A full reel of heavy-gage cable can be extremely heavy, weighing in excess of several hundred pounds, and it is difficult to handle when desired to wind or to unwind the cable from the reel.

Commercially available cable winding or unwinding devices designed to handle flanged reels are provided with an arm having a spindle to rotatably support a reel by its central opening. A drive pin mounted on the arm engages a recess on one of the reel flanges, which is spaced radially outwardly from the central opening of the reel. The drive pin is advanced along a circular path to rotate the reel in the desired direction.

This device is not entirely satisfactory because the installation of the reel on the support arm is a delicate procedure as it requires to manually pre-position the reel in a way to simultaneously align the central opening of the reel with the spindle of the supporting arm and the recess with the drive pin. This operation is labour-intensive especially with heavy reels.

OBJECTS AND STATEMENT OF THE INVENTION

An object of the invention is an improved method and apparatus for winding or unwinding cable from a reel.

More specifically, an object of the invention is an apparatus for winding or unwinding cable from a reel where the installation of the reel in the apparatus does not require labour-intensive manipulations of the reel.

As embodied and broadly described herein, the invention provides an apparatus for winding or unwinding cable from a reel, the reel comprising an elongated core on which cable is received in a coiled condition, and a generally circular flange mounted to the core and extending generally transversely to the core, said apparatus comprising:

an assembly for rotatably supporting the reel;

a reel drive, comprising:

a) a pair of rotatable pulleys in a spaced apart relationship;

b) a flexible belt passing over said pulleys, said pulleys establishing a path of travel for said flexible belt and rotating as said flexible belt advances along said path of travel, said flexible belt including a run for engaging a peripheral edge of the flange of the reel in a driving relationship, whereby advancement of said flexible belt along said path of travel causes the reel to rotate;

c) a motor in a driving relationship with said flexible belt to advance said flexible belt along said path of travel and cause rotation of the reel in either one of a winding and unwinding directions, in said winding direction cable being wound on the reel and in said unwinding direction cable being wound off the reel.

In a preferred embodiment, the flexible belt is endless and it extends in a generally coplanar relationship with the flange of the reel which is being driven by the belt. The motor is connected to one of the pulleys for advancing the belt along its path of travel.

Advantageously, the reel drive is mounted to an extremity of a movable arm permitting to selectively bring the reel drive in and out of engagement with the reel. This characteristic is particularly advantageous as it allows the apparatus to be used with various reel diameters. Further it allows the amount of pressure between the belt and the reel flange to be varied for slippage control.

Preferably, the reel supporting assembly includes a reel carrying arm provided with a spindle engaging the central opening of the reel. The reel carrying arm raises the reel at a certain distance above the ground and rotatably supports it in this position, whereby the reel can be rotated in the winding or in the unwinding direction by the reel drive.

As embodied and broadly described herein, the invention also comprises an apparatus for winding or unwinding a cable from a reel, the reel comprising a core on which cable is received in a coiled condition, and a pair of generally circular flanges, each flange being mounted to a respective end of the core and extending generally transversely to the core, said apparatus comprising:

a movable arm for rotatably supporting the reel;

a reel drive, comprising:

a) a pair of rotatable pulleys in a spaced apart relationship;

b) a motor in driving relationship with one of said pulleys for rotating said one pulley;

c) an endless flexible belt tensioned around said pulleys, said pulleys establishing a path of travel for said endless flexible belt, rotation of said one pulley causing said endless flexible belt to advance along said path of travel, said endless flexible belt having a run frictionally engaging a peripheral edge of one of the flanges of the reel, whereby advancement of said endless flexible belt along said path of travel causes the reel to rotate in either one of a winding and unwinding directions, in said winding direction cable being wound on the reel and in said unwinding direction cable being wound off the reel.

As embodied and broadly described herein, the invention also provides a method for winding or unwinding cable on a reel, the reel comprising a core on which cable is received in a coiled condition, and a pair of generally circular flanges, each flange being mounted to a respective end of the core and extending generally transversely to the core, said method comprising the steps of:

a) rotatably supporting the reel, whereby the reel is free to rotate in a winding direction and in an unwinding direction, rotation of the reel in said winding direction winding cable on the reel, rotation of the reel in said unwinding direction unwinding cable from the reel;

b) frictionally engaging a flexible belt on a peripheral edge of one of the flanges of the reel;

c) advancing said flexible belt along a predetermined path of travel while said flexible belt is in contact with the peripheral edge to rotate the reel in either one of said winding and unwinding directions.

DESCRIPTION OF A PREFERRED EMBODIMENT

Figure 1:
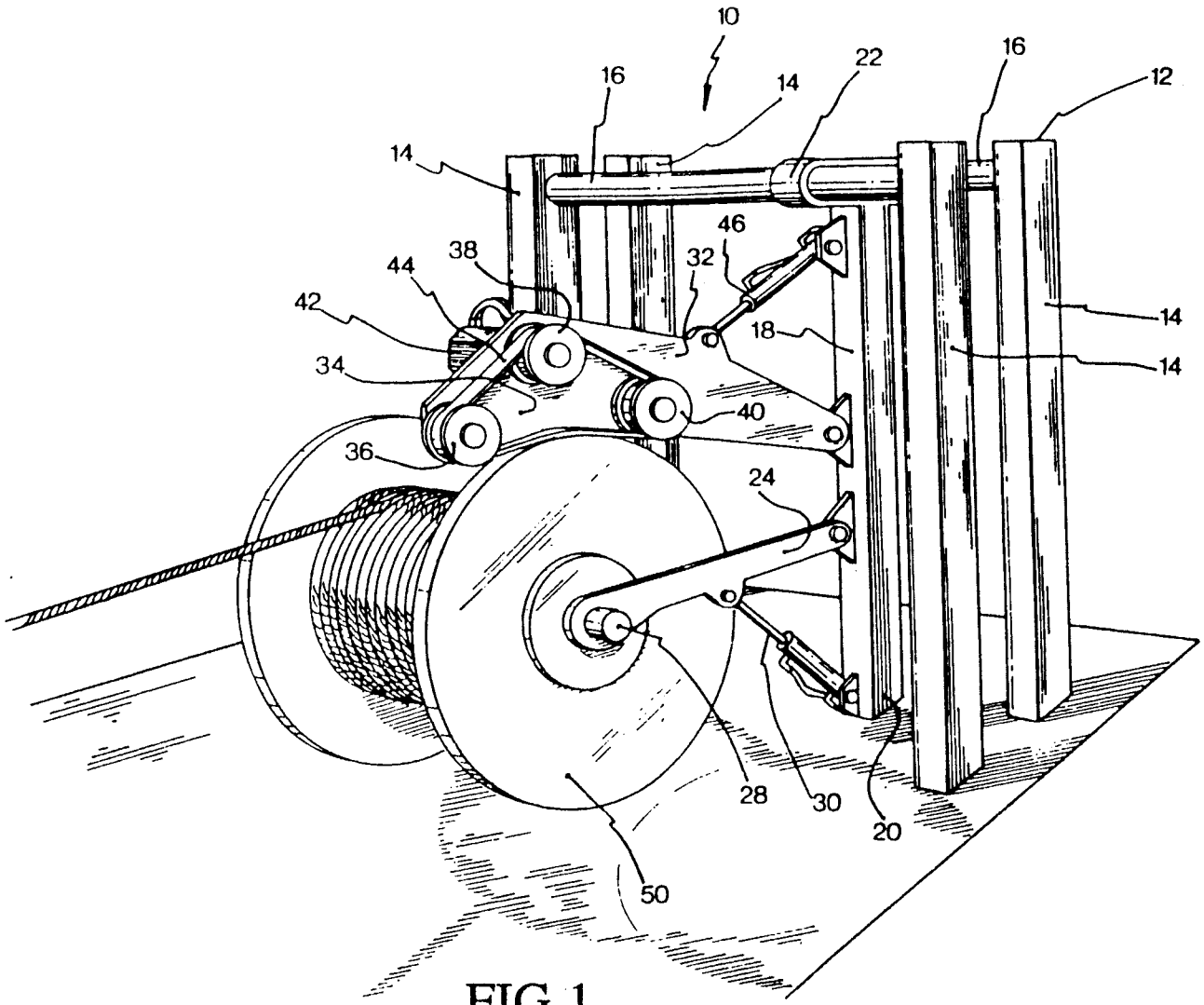
FIG. 1 is a perspective view of the apparatus for winding or unwinding cable, constructed in accordance with the present invention.
Figure 2:
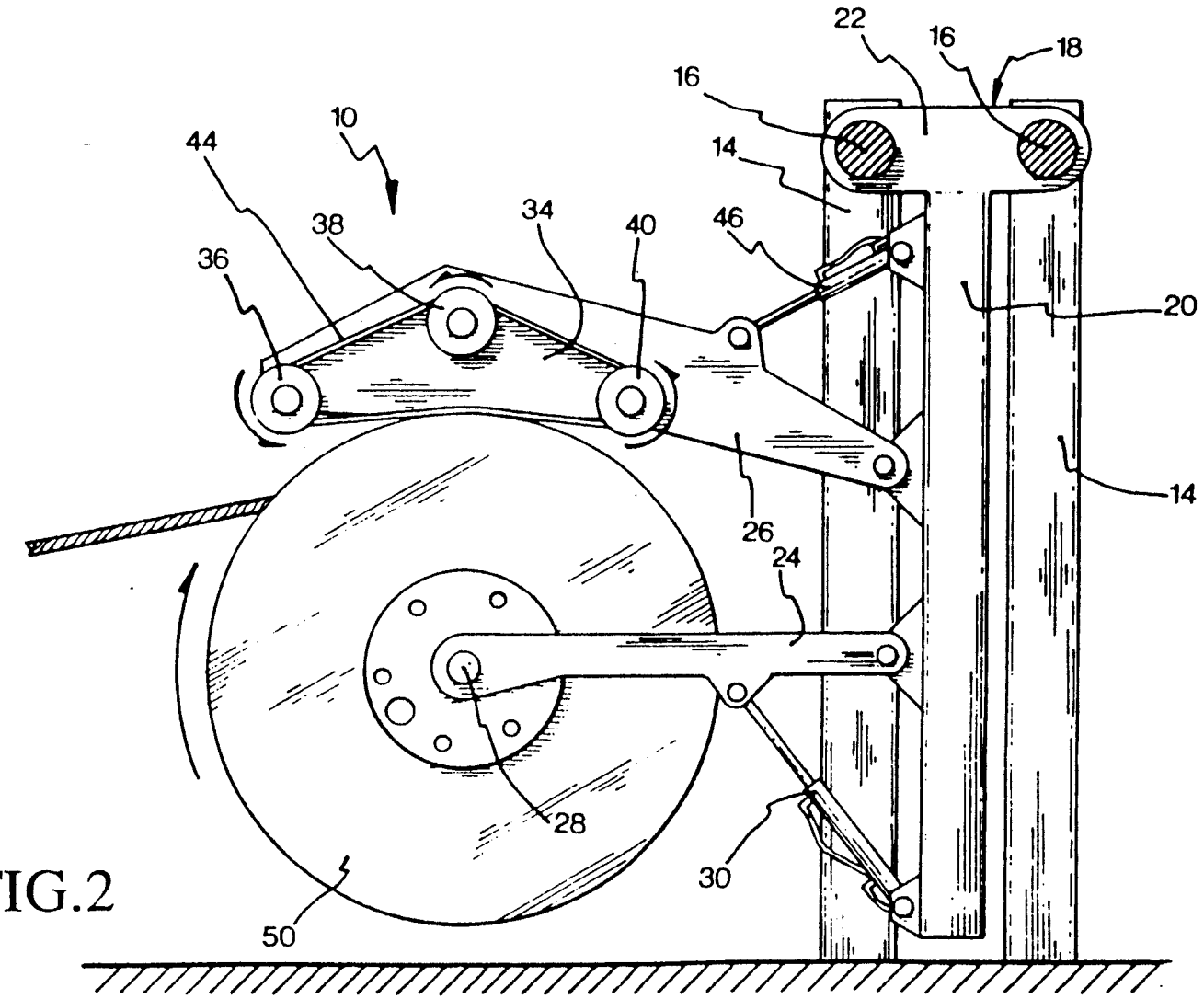
FIG. 2 is a vertical cross-sectional view of the apparatus shown in FIG. 1.

With reference to the annexed drawings, the numeral 10 designates comprehensively an apparatus for winding or unwinding cable from a reel, constructed in accordance with the present invention. The apparatus 10 may either be stationary for use in a cable manufacturing plant or mounted on a vehicle for unwinding cable from a reel at a cable installation site.

The machine 10 comprises a frame 12 constituted by four upstanding members 14 which are interconnected by two horizontally extending parallel rails 16 which form a guide track.

A reel handling carriage 18 is slidingly mounted on the guide track for horizontal movement between opposed pairs of upstanding members 14. In the embodiment shown in the drawings, the carriage is moved manually on the guide track, however, it should be understood that any suitable mechanism may be provided for moving the carriage automatically.

More specifically, the reel handling carriage comprises a main vertical body 20 depending from a support head 22 which slidingly engages the rails 16 of the guide track.

The main body 20 carries a reel supporting arm 24 and a reel drive 26 which engages the reel and rotates it in a winding or in an unwinding direction for winding the cable thereto or unwinding the cable therefrom, respectively.

The cable supporting arm 24 is pivotally mounted at one end about a generally horizontal axis to the body 20 and carrying at an opposite end a spindle 28 transversely extending to the longitudinal axis of the arm 24.

A hydraulic piston-cylinder assembly 30 is mounted between the arm 24 and the body 20 in order to pivot the arm 24 in a vertical plane. By extending the piston-cylinder assembly 30, the arm 24 moves upwardly. By contracting the piston-cylinder assembly 30, the arm 24 moves downwardly.

The reel drive 26 comprises an arm 32 pivotally mounted about a generally horizontal axis to the body 20 and having a free end forming a drive head 34. The head 34 comprises three pulleys 36, 38 and 40 which are rotatably mounted to the extremity of the arm 32 that forms the drive head 34. A hydraulic motor 42 is coupled to the pulley 38 to rotate same in the desired direction when operating fluid is being supplied to the motor 42. The pulleys 36 and 40 are idler pulleys.

A flexible belt 44 is tensioned around the pulleys 36, 38 and 40. The belt 44 advances along a generally triangular path when the pulley 38 is being rotated by the motor 42.

The arm 32 is movable up or down by means of a hydraulic piston-cylinder assembly 46 connected between the arm 32 and the body 20. It will be appreciated that by retracting the piston-cylinder assembly 46 the drive head 34 is caused to move upwardly. The reverse movement is achieved by extending the piston-cylinder assembly 46.

The operation of the apparatus 10 is as follows. A reel 50 having a cylindrical core (not shown) and circular flanges at each end of the core is rolled in front of the apparatus 10. If necessary, the arm 24 is pivoted upwardly or downwardly in order to locate the spindle 20 in alignment with the central opening of the reel. The reel handling carriage is moved on the guide track toward the reel 50 until the spindle 28 fully enters in the central opening of the reel. The piston-cylinder assembly 30 is then extended in order to pivot upwardly the arm 24 and raise the reel 50 off the ground. In this position, the reel is rotatably supported on the arm 24.

The piston cylinder assembly 46 is actuated to lower the arm 32 and engage the drive head 34 with one flange of the reel 50. More particularly, the run of the flexible belt 44 between the pulleys 36 and 40 frictionally engages the peripheral edge of the flange along a sector having a certain length. The length of this sector may be increased for a better grip by increasing the pressure of the drive head 34 against the reel flange. The limiting factor in increasing the length of the sector by pressing the drive head 34 against the flange is the distance between the pulleys 36 and 40. When the pulleys engage the flange peripheral edge a further increase in pressure will no longer produce a corresponding increase of the sector length.

The vertical adjustability of the arm 26 also permits to adjust the drive head 34 to suit various reel diameters.

The motor 42 is actuated to drive the pulley 38 and simultaneously to advance the flexible belt 44 along its path. The advancement of the belt 44 causes the rotation of the reel 50 in the desired direction to either wind or unwind the cable.

The above description of this invention should not be interpreted in any limiting manner as variations and refinements are possible without departing from the spirit of the invention. The scope of the invention is defined in the appended claims.

I claim:

1. An apparatus for winding or unwinding cable from a reel, the reel comprising an elongated core on which cable is received in a coiled condition, and a generally circular flange mounted to the core and extending generally transversely to the core, said apparatus comprising:

an assembly for rotatably supporting the reel;

a reel drive, comprising:

a) a pair of rotatable pulleys in a spaced apart relationship;

b) a flexible belt passing over said pulleys, said pulleys establishing a path of travel for said flexible belt, said pulleys rotating as said flexible belt advances along said path of travel, said flexible belt including a run engaging a peripheral edge of the flange of the reel in a driving relationship, whereby advancement of said flexible belt along said path of travel causes the reel to rotate;

c) a motor in a driving relationship with said flexible belt to advance said flexible belt along said path of travel and cause rotation of the reel in either one of a winding and unwinding directions, in said winding direction cable being wound on the reel and in said unwinding direction cable being wound off the reel.

2. An apparatus as defined in claim 1, wherein said flexible belt is endless.

3. An apparatus as defined in claim 1, wherein said motor is coupled to one of said pulleys to advance said flexible belt by rotating said one pulley.

4. An apparatus as defined in claim 2, wherein said flexible belt defines a loop generally coplanar with the flange of the reel.

5. An apparatus as defined in claim 1, wherein said assembly is vertically movable to vertically displace the reel.

6. An apparatus as defined in claim 1, wherein said assembly comprises a spindle for rotatably engaging a central opening in the reel.

7. An apparatus as defined in claim 1, wherein said reel drive is selectively movable in and out of engagement with the peripheral edge of the flange of the reel.

8. An apparatus as defined in claim 1, comprising means for urging said flexible belt against the flange of the reel.

9. An apparatus as defined in claim 1, comprising means for controlling a pressure of said flexible belt against the flange of the reel.

10. An apparatus as defined in claim 1, wherein said reel drive comprises three pulleys, said flexible belt passing around said three pulleys.

11. An apparatus as defined in claim 1, comprising a reel handling carriage selectively movable on a frame of said apparatus, said assembly and said reel drive being mounted to said reel handling carriage.

12. An apparatus as defined in claim 11, wherein said frame includes a generally horizontal guide track, said reel handling carriage being slidingly mounted to said reel handling carriage for horizontal movement thereon.

13. An apparatus for winding or unwinding a cable from a reel, the reel comprising a core on which cable is received in a coiled condition, and a pair of generally circular flanges, each flange being mounted to a respective end of the core and extending generally transversely to the core, said apparatus comprising:

a movable arm for rotatably supporting the reel;

a reel drive, comprising:

a) a pair of rotatable pulleys in a spaced apart relationship;

b) a motor in driving relationship with one of said pulleys for rotating said one pulley;

c) an endless flexible belt tensioned around said pulleys, said pulleys establishing a path of travel for said endless flexible belt, rotation of said one pulley causing said endless flexible belt to advance along said path of travel, said endless flexible belt having a run frictionally engaging a peripheral edge of one of the flanges of the reel, whereby advancement of said endless flexible belt along said path of travel causes the reel to rotate in either one of a winding and unwinding directions, in said winding direction cable being wound on the reel and in said unwinding direction cable being wound off the reel.

14. A method for winding or unwinding cable on a reel, the reel comprising a core on which cable is received in a coiled condition and a pair of generally circular flanges, each flange being mounted to a respective end of the core and extending generally transversely to the core, said method comprising the steps of:

a) rotatably supporting the reel, whereby the reel is free to rotate in a winding direction and in an unwinding direction, rotation of the reel in said winding direction winding cable on the reel, rotation of the reel in said unwinding direction unwinding cable from the reel;

b) frictionally engaging a flexible belt on a peripheral edge of one of the flanges of the reel;

c) advancing said flexible belt along a predetermined path of travel while said flexible belt is in contact with the peripheral edge to rotate the reel in either one of said winding and unwinding directions.

15. A method as defined in claim 14, further comprising the step of controlling a pressure between said endless flexible belt and the peripheral edge of the flange of the reel to control a grip of said endless flexible belt on said peripheral edge.

* * * * *